United States Patent [19]

Hoppie

[11] 4,448,176

[45] May 15, 1984

[54] METHOD FOR REDUCING IGNITION DELAY OF FUELS

[75] Inventor: Lyle O. Hoppie, Birmingham, Mich.

[73] Assignee: Eaton Corporation, Cleveland, Ohio

[21] Appl. No.: 350,780

[22] Filed: Feb. 22, 1982

[51] Int. Cl.[3] ..... F02M 31/00

[52] U.S. Cl. ..... 123/558; 123/557

[58] Field of Search ..... 123/557, 558

[56] References Cited

U.S. PATENT DOCUMENTS

| | | | |
|---|---|---|---|
| 2,744,507 | 5/1958 | Huber | 123/557 |
| 3,762,378 | 10/1973 | Bitonti | 123/557 |
| 4,083,340 | 4/1978 | Furr | 123/558 |
| 4,201,167 | 5/1980 | Bayley | 123/557 |

OTHER PUBLICATIONS

Gerrish, H. C. and Ayer, B. E., "Influence of Fuel-Oil Temperature in A Prechamber Compression-Ignition Engine", NACA TN 565, 1936.

Holmes, V. V. et al. "Combustion of a Low-Volatility Fuel in a Turbojet Combustion Chamber-Effects of Fuel Vaporization", TRANS ASME 75, pp. 1303-1310.

Spadaccini, L. J., "Autoignition Characteristics of Hydrocarbon Fuels at Elevated Temperatures and Pressures", ASME Paper No. 76-GT-3, 1976.

*Primary Examiner*—Ronald H. Lazarus

*Attorney, Agent, or Firm*—C. H. Grace; P. S. Rulon

[57] ABSTRACT

A method of reducing ignition delay $\tau$, of fuels to negligible values and negligible differences is disclosed. Fuels conditioned to have such negligible values and differences are readily used in multiple fuel engines, such fuels self-ignite substantially instantaneously when injected into an oxidant, require substantially no heat transfer from the oxidant to effect the self-ignition, and the self-ignition is sufficient to sustain continued combustion.

7 Claims, 3 Drawing Figures

METHOD FOR REDUCING IGNITION DELAY OF FUELS

FIELD OF THE INVENTION

The invention relates to a method of reducing ignition delay of fuels. More specifically the invention relates to a method of reducing ignition delay of hydrogen and/or carbon fuels used in combustion engines, particularly internal combustion engines of the Diesel Cycle type. Still more specifically, the invention relates to a method of reducing ignition delay of a family of fuels to negligible amounts and negligible differences.

BACKGROUND OF THE INVENTION

Ignition delay or lag of fuels is well-known and is generally defined as the time interval between initial injection of a fuel into an oxidant and ignition or exothermic oxidation sufficient to sustain continued combustion. It is also well-known that different fuels have different ignition delays and that a major obstacle of multiple fuel engines is the difference in ignition delay. Theories as to the cause of ignition delay abound. One rather widely accepted theory holds that only radicals of fuel molecules oxidize, that is, ignite or combust and that ignition delay is the time interval between initial injection of the fuel molecules into an oxidizing medium such as air and the formation and oxidation of radicals in sufficient number to sustain continued combustion. Parameters believed to affect the formation of radicals are initial pressure in a combustion chamber and preheating of the fuel and/or air. Whether or not this theory is correct, empirical data clearly shows that initial pressure in a combustion chamber and preheating of the fuel and/or air affects ignition delay.

Numerous investigations have been performed on ignition delay of fuel injected into air. The majority of these investigations concentrated on the effects of initial combustion chamber pressure and initial air temperature on ignition delay since other investigations had shown preheated fuel at temperatures as high as 500 degrees Kelvin (°K.) had little or no effect on ignition delay. However, when a few investigators did preheat fuel to temperatures considerably above 500° K., they found significant decreases in ignition delay.

For example, H. C. Gerrish and B. E. Ayer disclosed in 1936 measured ignition delays of fuel preheated between 324° K. and 672° K. in a compression ignition engine of swirl chamber design and running at 1500 RPM or $9\times10^3$ crankshaft angle degrees per second. At 324° K., measured delays were approximately ten crankshaft degrees or $1.1\times10^{-3}$ seconds. At 672° K., measured ignition delays were approximately six crankshaft degrees or $0.67\times10^{-3}$ seconds. Comparisonwise, the ignition delays decreased $0.43\times10^{-3}$ seconds or 39%.

Further, V. V. Holmes et al. in 1975 disclosed the effects of fuel vaporization on combustion in a combustion chamber for a turbojet engine. Visable observations were made of flame distance from a nozzle injecting fuel at increasing preheated fuel temperatures into an open atmosphere without forced air movement. The observed visible flame distance decreased with increased fuel preheating and thereby suggested decreasing ignition delay with increased preheating. No visible distance was observed between the nozzle and flame for preheated fuel above 617° K.

Still further, L. J. Spadaccini in 1976 disclosed results obtained in a steady-flow test facility in which ignition delay of various fuels was measured by varying not only the temperature of preheated air, but also by varying the temperature of preheated fuel to temperatures as high as 700° K. Spadaccini's results are summarized herein in FIG. 1, plotting ignition delay, $\tau$, versus reciprocal air temperature.

While the above-mentioned investigations are significant and add to our knowledge of ignition delay, they fail to disclose or suggest that ignition delay can be reduced to negligible amounts such as $5\times10^{-5}$ seconds or less. Further, they fail to disclose or suggest that ignition delays of fuels of different molecular structure, i.e., families of fuels, can be made both negligible and negligibly different.

By way of example, ignition delays in the order of $5\times10^{-5}$ seconds in a piston engine at 1500 RPM equate to 0.45 crankshaft angle degrees compared to the six crankshaft angle degrees in the Gerrish and Ayer investigation. Further, even if the engine were operated at speeds on the order of 6,000 RPM, ignition delay would still be less than 1.8 crankshaft angle degrees.

The advantages of negligible ignition delays or substantially instantaneous combustion are many. For example, it is well-known that piston or expandable chamber engines fail to efficiently and completely combust fuel due to ignition delay. In such engines, fuel with a negligible ignition delay could be injected into the expandable chamber at the precise or optimum moment to effect combustion and useful work. In a Diesel Cycle engine, such fuel could be injected at a rate necessary to effect true constant pressure combustion, thereby preventing diesel knock which is not only annoying but also detrimental to engine structure and combustion efficiency. Families of fuels conditioned to have both negligible ignition delays and ignition delay differences make possible the conversion of virtually all combustion engines to the use of multiple fuels.

SUMMARY OF THE INVENTION

An object of the invention is to provide fuels having negligible ignition delays.

Another object of this invention is to provide fuels having both negligible ignition delays and negligible ignition delay differences.

According to an important feature of the invention the ignition delay, $\tau$, of a fuel is ascertained according to a relation wherein $$\tau\sim(1/KwN_o)e^{Ea/RT_f},$$

the fuel is then heated to at least a temperature $T_f$ prior to injection into an oxidant; and the fuel at temperature $T_f$ is then injected into the oxidant.

DETAILED DESCRIPTION OF THE INVENTION

It is well-known that a fuel molecule (or any molecule, for that matter) has discreet energy levels corresponding to various longitudinal, rotational, and torsional modes of oscillation. For a total assembly of such molecules, $N_o$, in thermal equilibrium at or above room temperature, the number of molecules, N, in each energy level would be governed by Boltzmann statistics, given by:

$$N = Ce^{-E/kT}$$

wherein C is a constant, E is the internal energy of the molecules, k is Boltzmann Constant, and T is in degrees Kelvin.

It is also known that in a combusting mixture of a given fuel and oxidant, radicals of the fuel molecules can be observed in front of the flame front and furthermore that the radical density increases drastically as the flame front approaches, i.e., as the temperature increases. It is usually assumed that these radicals exist only when combustion is apparent or imminent. However, if the fuel radicals are interpreted simply as additional allowed energy states of the fuel molecules, it follows that in thermal equilibrium there will be a finite number of molecules in the radical states even if combustion is neither apparent nor imminent. For example, for a given total assembly of molecules, $N_o$, in thermal equilibrium at or somewhat above room temperature there will be finite but miniscule numbers of molecules, n, in the radical states. If all of the molecules in radical states are referred to as excited states of the fuel and all of the other molecules not in the radical states are referred to as ground states, the total assembly of molecules, $N_o$, can be visualized as a simple two energy level system. Further, and in keeping with the previously stated theory wherein only radicals can be oxidized, the following hypotheses can be made:

1. molecules in the ground states cannot be oxidized, and
2. molecules in the excited states can be oxidized at rates dependent on the concentration of oxygen and the concentration of molecules in the excited states.

Figure 1:
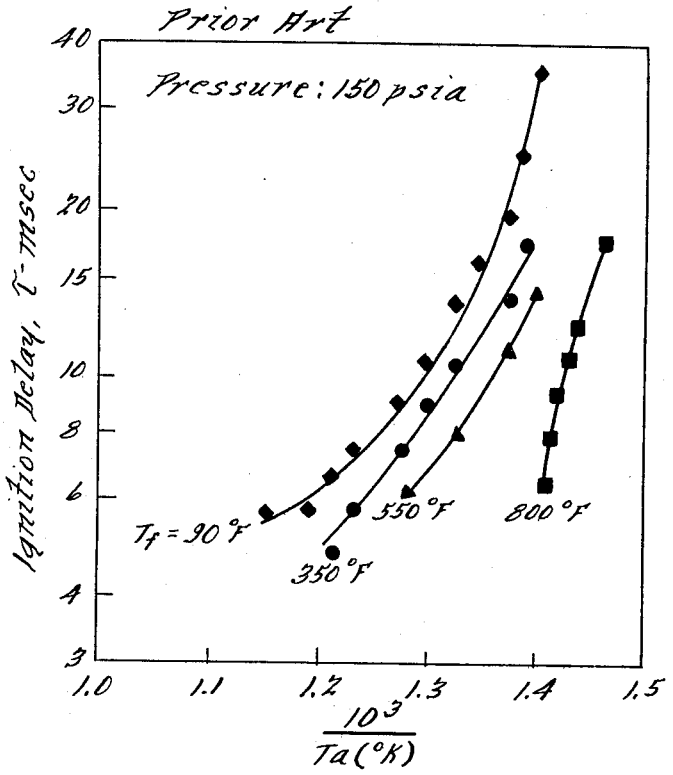
FIG. 1 is a prior art graph showing ignition delay, $\tau$, of a fuel at several different air and fuel temperatures.
Figure 2:
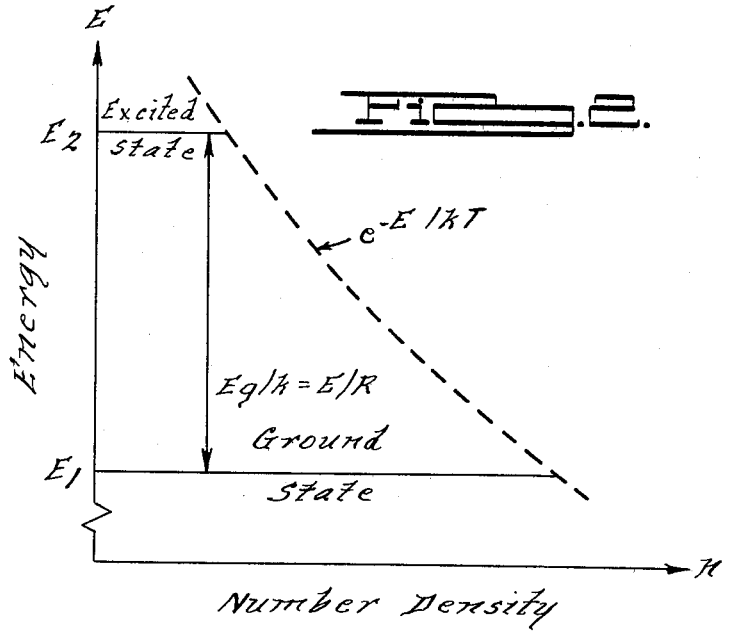
FIG. 2 is a graph showing energy levels of fuel molecules.

FIG. 2 graphically illustrates the qualitative number density, n, of molecules in the ground and excited states. Energy level $E_1$ represents the highest energy level for all molecules at the ground states. Energy level $E_2$ represents the lowest energy level for all molecules at the excited states. The energy gap, $E_g$, between the two states is defined as $$E_g = E_a k/R \tag{1}$$

wherein $E_a$ is the so-called activation energy of the fuel. The expression $e^{-E/kT}$ is of course the general expression for the molecules in each energy level according to Boltzmann statistics.

For the simple two energy level system thus further defined, rate equations describing transition between the two states can be written as $$\frac{dn_1}{dt} = -w_{12}n_1 + w_{21}n_2 \tag{2}$$

$$\frac{dn_2}{dt} = w_{12}n_1 - w_{21}n_2 - wn_2 \tag{3}$$

wherein t is time, $n_1$ and $n_2$ are the densities of molecules in the ground and excited states, respectively, and $w_{12}$ and $w_{21}$ are the transition rates between the ground and excited states. These equations are the same as for any two energy level system, except for the final term of equation 3; this term allows oxidation of molecules in the excited states and states that the rate of such reactions is proportional to the density of excited molecules, $n_2$. Presumably, w itself depends on the oxygen concentration since in the absence of oxygen, oxidation does not occur.

Heat given up to the surroundings as excited molecules oxidize is given by $$\frac{dT_s}{dt} = Kwn_2 \tag{4}$$

wherein $T_s$ is the temperature of the surrounding and K is the temperature rise which results when one fuel molecule is oxidized.

Equations 2–4 are readily extended to multienergy level systems. Consider, for example, a system having M energy levels arbitrarily numbered in ascending order from the lowest energy level, 1, to the highest energy level, M. In such a system the first m states are assumed to be ground states and the remaining states, m+1 through M, are excited states. For brevity, the set of equations for the multienergy level system are not given.

Equation 4 states that the rate of heat release is directly proportional to the number of molecules in the excited state. Hence, if $n_2$ is somewhat increased prior to the fuel being exposed to oxygen, the observed ignition delay, $\tau$, should decrease. According to the two energy level system, $\tau$ can be decreased simply by increasing the fuel temperature prior to injecting or exposing the fuel to oxygen. To show this, assume the fuel is in thermal equilibrium with itself at a temperature $T_f$ and that no oxygen is present. Then w=o (since there is no oxygen) and the densities of states 1 and 2 are constant:

$$\frac{dn_1}{dt} = \frac{dn_2}{dt} = O = -w_{12}n_1 + w_{21}n_2 \tag{5}$$

Assuming Boltzmann statistics apply, $$\frac{n_2}{n_1} = \frac{w_{12}}{w_{21}} = e^{-Eg/kTf} = e^{-Ea/RTf} \tag{6}$$

At room temperature and assuming an activation energy, $E_a$, of 30K cal/mole, $$\frac{n_2}{n_1} = 10^{-22}$$

For the same fuel at $10^{3°}$ K. (1000° K.), $$\frac{n_2}{n_1} = 3 \times 10^{-7}$$

Referring to equation 4, significant differences in ignition delay, $\tau$, for the fuel at these two temperatures is clearly indicated. A somewhat formal solution to equations 2–4 will now be derived, subject to the following boundary conditions:

1. at $t = O$, $n_1 + n_2 = N_o$;

-continued 2. at $t = O, \frac{n_2}{n_1} = e^{-Ea/RTf}$, wherein $T_f$ is the fuel temperature prior to injection; and 3. at t=O, $T_s = T_a$, wherein $T_a$ is air temperature prior to injection of the fuel.

The results are $$\frac{n_1}{N_o} = \frac{1}{D}\left[-\left(1 - \frac{w}{s_+}\right)Ae^{-s+t} + \left(1 - \frac{s_-}{w}\right)Be^{-s-t}\right] \quad (7)$$

$$\frac{n_2}{N_o} = \frac{1}{D}\left(Ae^{-s+t} + \frac{s_-}{w}Be^{-s-t}\right) \quad (8)$$

$$\frac{dT_s}{dt} = Kwn_2 \quad (9)$$

wherein $$S_\pm = \tfrac{1}{2}((w_{12} + w_{21} + w) \pm [(w_{12} + w_{21} + w)^2 - 4ww_{12}]^{\frac{1}{2}}) \quad (10)$$

$$A = \left(1 - \frac{s_-}{w}\right) e^{-Ea/RTf} - \frac{s_-}{w} \quad (11)$$

$$B = \left(1 - \frac{w}{s_+}\right) e^{-Ea/RTf} + 1 \quad (12)$$

$$D = \left(1 - \frac{s_-}{s_+}\right) (1 + e^{-Ea/RTf}) \quad (13)$$

If it is assumed $$w << w_{12} + w_{21}$$

a considerable simplification results since in this limit, $T_f$ approaches $T_s$ as t approaches infinity. Under these assumptions, equations 8–13 can be simplified and combined to give an approximate solution:

$$\frac{dT_s}{dt} \simeq KwN_o[e^{-Ea/RTs}(1 - e^{-t/t1}) + e^{-Ea/RTf - t/t1}] \quad (14)$$

wherein $t_1$ is a time constant given by $$t_1 = (w_{12} + w_{21})^{-1}$$

and can be expected to be different for various or different fuels. This approximate solution of equation 14 will now be applied to a case wherein: at t=o, $T_f >> T_a$ (hot fuel injected into air). Here the last term of equation 14 is assumed to dominate and it is presumed that ignition will occur within a time interval shorter than $t_1$. Thus $$\frac{dT_s}{dt} \simeq KwN_o e^{-Ea/RTf} \quad (15)$$

or, $$\tau \sim \frac{1}{KwN_o} e^{Ea/RTf} \quad (16)$$

This result predicts that the ignition delay, $\tau$, can be made arbitrarily small if the initial oxygen concentration and fuel temperature are sufficiently high. Furthermore, it predicts that in this limit, the ignition delay will be independent of air temperature.

Figure 3:
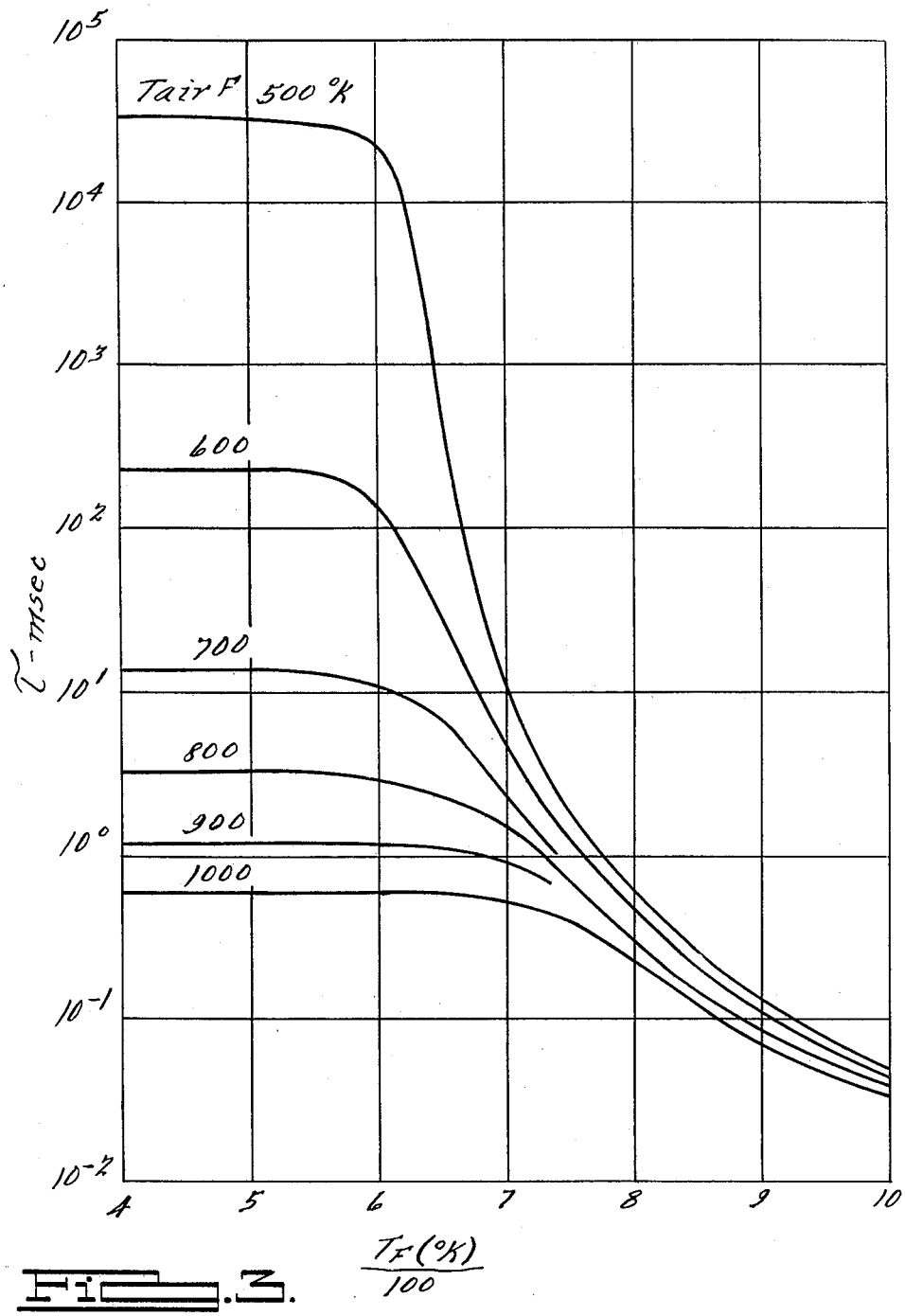
FIG. 3 is a graph illustrating convergence of ignition delay independent of air temperature.

FIG. 3 graphically illustrates values of $\tau$ for a cetane fuel in air. At $T_f$ equals 1000° K., $\tau$ is approximately $5 \times 10^{-5}$, a negligible amount, and substantially independent of air temperature.

The following claims are intended to cover the disclosed invention and variation within the spirit of the invention.

What is claimed is:

1. A method of reducing ignition delay, $\tau$, of a fuel, to a negligible value, comprising the steps of:

determining $\tau$ according to a relation wherein $$\tau \sim (1/KwN_o)e^{+Ea/RTf};$$

where $\tau$ is the ignition delay,

K is the temperature rise when one fuel molecule is oxidized, w is the reaction rate of the fuel molecules in air, $N_o$ is the density of molecules in ground and excited states at time (t)=O, e is the base of natural logarithms, $E_a$ is the activation energy of the fuel, R is the universal gas constant, and $T_f$ is the temperature of the fuel; and heating the fuel prior to injection into an oxidant to a temperature $T_f$ such that the fuel self-ignites substantially instantaneously when injected into an oxidant, such that the fuel requires substantially no heat transfer from the oxidant to effect said self-ignition, and such that the amount of said self-ignition is sufficient to sustain continued combustion.

2. A method of reducing ignition delay, $\tau$, of fuels to negligible amounts, comprising the steps of:

ascertaining a negligible $\tau$ according to a relation wherein $$\tau \sim (1/KwN_o)e^{+Ea/RTf},$$

where $\tau$ is the ignition delay,

K is the temperature rise when one fuel molecule is oxidized, w is the reaction rate of the fuel molecules in air, $N_o$ is the density of molecules in ground and excited states at time (t)=O, e is the base of natural logarithms, $E_a$ is the activation energy of the fuel, R is the universal gas constant, and $T_f$ is the temperature of the fuel;

heating the fuel to at least a temperature $T_f$ providing said negligible $\tau$ according to said relation; and injecting the fuel into an oxidant at the temperature $T_f$ such that the fuel self-ignites substantially instantaneously, such that the fuel requies substantially no heat transfer from the oxidant to effect said self-ignition, and such that the amount of self-ignition is sufficient to sustain continued combustion.

3. The method of claim 2, further comprising the additional step of:

ascertaining negligible $\tau$ differences for each of said fuels prior to heating and injecting each of the fuels into an oxidant to facilitate use of multiple fuels in said oxidant.

4. A method of reducing ignition delay, $\tau$, of a fuel such that the fuel self-ignites substantially instantaneously when injected into an oxidant independent of the oxidant temperature, comprising the steps of:

ascertaining a $\tau$ of less than 0.1 msec for the fuel according to a relation wherein $$\tau \sim (1/KwN_o)e^{+Ea/RT_f},$$

where $\tau$ is the ignition delay,

K is the temperature rise when one fuel molecule is oxidized, w is the reaction rate of the fuel molecules in air, $N_o$ is the density of molecules in ground and excited states at time (t)=O, e is the base of natural logarithms, $E_a$ is the activation energy of the fuel, R is the universal gas constant, and $T_f$ is the temperature of the fuel;

heating the fuel to a temperature, $T_f$ prior to injection into the oxidant such that said $\tau$ is satisfied and such that the fuel requires substantially no heat transfer from said oxidant to effect ignition sufficient to sustain continued combustion.

5. A method of reducing ignition delay of hydrogen and/or carbon fuels of varying molecular structure in an oxidant such that the ignition delay, $\tau$, of the fuels is substantially instantaneous, independent of the oxidant temperature, and within a time period defined by a relation wherein $$\tau \sim \frac{1}{KwN_o} e^{+Ea/RT_f},$$

where $\tau$ is the ignition delay,

K is the temperature rise when one fuel molecule is oxidized, w is the reaction rate of the fuel molecules in air, $N_o$ is the density of molecules in ground and excited states at time (t)=O, e is the base of natural logarithms, $E_a$ is the activation energy of the fuel, R is the universal gas constant, and $T_f$ is the temperature of the fuel;

comprising the steps of:

ascertaining the maximum acceptable $\tau$ for each of said fuels;

heating each of said fuels to a temperature, $T_f$, prior to injection into the oxidant such that said maximum $\tau$ is satisfied and such that each of said fuels require substantially no heat transfer from said oxidant to said molecules prior to ignition sufficient to sustain continued combustion.

6. A method of reducing ignition delays of a family of hydrogen and/or carbon fuels in an oxidant substantially independent of oxidant temperature to facilitate the use of multiple fuels in an internal combustion engine, comprising the steps of:

ascertaining the maximum acceptable ignition delay, $\tau$, for the family of fuels according to a relation wherein $$\tau \sim (1/KwN_o)e^{+Ea/RT_f},$$

where $\tau$ is the ignition delay,

K is the temperature rise when one fuel molecule is oxidized, w is the reaction rate of the fuel molecules in air, $N_o$ is the density of molecules in ground and excited states at time (t)=O, e is the base of natural logarithms, $E_a$ is the activation energy of the fuel, R is the universal gas constant, and $T_f$ is the temperature of the fuel;

heating each of said fuels prior to injection into the oxidant to a temperature, $T_f$, satisfying said maximum $\tau$; and injecting said heated fuel into said chamber.

7. A method of controlling combustion of a given hydrogen and/or carbon fuel in an expandable chamber of a Diesel Cycle engine such that combustion occurs at substantially constant pressure, comprising the steps of ascertaining a substantially instantaneous ignition delay, $\tau$, for said fuel as defined by a relation wherein $$\tau \sim \frac{1}{KwN_o} e^{+Ea/RT_f},$$

where $\tau$ is the ignition delay,

K is the temperature rise when one fuel molecule is oxidized, w is the reaction rate of the fuel molecules in air, $N_o$ is the density of molecules in ground and excited states at time (t)=O, e is the base of natural logarithms, $E_a$ is the activation energy of the fuel, R is the universal gas constant, and $T_f$ is the temperature of the fuel;

heating said given fuel to a temperature, $T_f$, satisfying said $\tau$ prior to injection into an oxidant in the chamber; and injecting said heated fuel into the chamber at a rate increasing with time and for a time period increasing with engine load.

* * * * *